US009461394B2

(12) United States Patent
McClellan et al.

(10) Patent No.: US 9,461,394 B2
(45) Date of Patent: Oct. 4, 2016

(54) ELECTRICAL CONTACTS FOR ELECTRICAL CONNECTORS

(71) Applicant: Tyco Electronics Corporation, Berwyn, PA (US)

(72) Inventors: Justin Shane McClellan, Camp Hill, PA (US); Jeffrey Byron McClinton, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 14/315,526

(22) Filed: Jun. 26, 2014

(65) Prior Publication Data

US 2016/0056564 A1 Feb. 25, 2016

(51) Int. Cl.
*H01R 13/05* (2006.01)
*H01R 13/502* (2006.01)

(52) U.S. Cl.
CPC ..... *H01R 13/502* (2013.01)

(58) Field of Classification Search
CPC ..... H01R 13/05–13/057; H01R 13/112
See application file for complete search history.

(56) References Cited

U.S. PATENT DOCUMENTS

| | | | | |
|---|---|---|---|---|
| 3,581,272 | A * | 5/1971 | Yopp | H01R 13/052 439/825 |
| 3,588,789 | A * | 6/1971 | Kailus | H01R 13/02 439/732 |
| 4,416,504 | A * | 11/1983 | Sochor | H01R 13/05 439/746 |
| 4,825,541 | A * | 5/1989 | Czeschka | H01R 43/16 29/874 |
| 2007/0042649 | A1 * | 2/2007 | Russelburg | H01R 4/185 439/857 |

* cited by examiner

*Primary Examiner* — Gary Paumen

(57) ABSTRACT

An electrical connector includes a connector housing configured to engage a mating connector during a mating operation. A contact array includes pin contacts coupled to the connector housing. Each of the pin contacts have an elongated body including a central plane that extends along a longitudinal axis to a mating end. Each of the pin contacts has first and second deflectable beams at the mating end. The first deflectable beam are configured to engage a first flexible contact finger of the mating connector and deflect toward the central plane during the mating operation. The second deflectable beam is configured to engage a second flexible contact finger of the mating connector and deflect toward the central plane during the mating operation.

20 Claims, 7 Drawing Sheets

ELECTRICAL CONTACTS FOR ELECTRICAL CONNECTORS

BACKGROUND OF THE INVENTION

The subject matter herein relates generally to electrical contacts for electrical connectors.

Electrical connectors are used to transmit data and/or power in various industries. The electrical connectors are often configured to repeatedly engage and disengage complementary electrical connectors. The process of mating the electrical connectors may be referred to as a mating operation. In some applications, such as in a backplane communication system, numerous electrical contacts are simultaneously mated. The mating forces of each of the electrical contacts are cumulative. A need remains for electrical contacts that are designed to lower mating forces during a mating operation.

BRIEF DESCRIPTION OF THE INVENTION

In an embodiment, an electrical connector is provided that includes a connector housing configured to engage a mating connector during a mating operation. A contact array includes pin contacts coupled to the connector housing. Each of the pin contacts have an elongated body that extends along a longitudinal axis to a mating end. Each of the pin contacts has first and second deflectable beams at the mating end. The first deflectable beam are configured to engage a first flexible contact finger of the mating connector and deflect toward the central plane during the mating operation. The second deflectable beam is configured to engage a second flexible contact finger of the mating connector and deflect toward the central plane during the mating operation.

In another embodiment, a communication system is provided that includes a receptacle connector having a contact array of receptacle contacts each having first and second flexible contacts opposing each other across a socket gap. The communication system includes a header connector having a contact array of header contacts that engage corresponding receptacle contacts of the receptacle connector. Each of the header contacts have an elongated body that extends along a longitudinal axis to a mating end. Each of the header contacts has first and second deflectable beams at the mating end. The header contacts are received in the socket gaps of corresponding receptacle contacts during the mating operation. The first deflectable beam engages the first flexible contact finger of the mating connector such that the first deflectable beam is deflected inward toward the central plane and such that the first flexible contact finger is deflected outward away from the central plane. The second deflectable beam engages the second flexible contact finger of the mating connector such that the second deflectable beam is deflected inward toward the central plane and such that the second flexible contact finger is deflected outward away from the central plane.

In another embodiment, an electrical contact is provided that includes an elongated body that extends along a longitudinal axis. The elongated body has a U-shaped profile along the longitudinal axis defined by a generally planar first arm, a generally planar second arm parallel to the first arm and spaced apart by a body gap, and a folded end connecting the first and second arms. The first and second arms having exterior surfaces facing in opposite directions that are configured to engage corresponding first and second flexible contact fingers of a mating connector during a mating operation. The elongated body extends to a mating end. A first deflectable beam is provided at the mating end extending forward from the first arm. The first deflectable beam is pitched inward to at least partially extend across the body gap. The first deflectable beam is configured to engage the first flexible contact finger and deflect toward the central plane during the mating operation. A second deflectable beam is provided at the mating end extending forward from the second arm. The second deflectable beam is pitched inward to at least partially extend across the body gap. The second deflectable beam is configured to engage the second flexible contact finger and deflect toward the central plane during the mating operation.

DETAILED DESCRIPTION OF THE INVENTION

Embodiments set forth herein may include electrical contacts, electrical connectors having the electrical contacts, and communication systems having the electrical connectors. Embodiments may be configured to reduce mating forces between electrical connectors compared to other known contacts, connectors, or systems. Although the illustrated embodiment includes electrical connectors that are used in high-speed communication systems, such as backplane or midplane communication systems, it should be understood that embodiments may be used in other communication systems or in other systems/devices that utilize electrical connectors. Accordingly, the inventive subject matter is not limited to the illustrated embodiment.

In order to distinguish similar elements in the detailed description and claims, various labels may be used. For example, an electrical connector may be referred to as a header connector, a receptacle connector, or a mating connector. Electrical contacts may be referred to as header contacts, pin contacts, electrical contacts or mating contacts. When similar elements are labeled differently (e.g., header contacts and pin contacts), the different labels do not necessarily require structural differences. For instance, in some embodiments, the header contacts described herein may be referred to as pin contacts.

Figure 1:
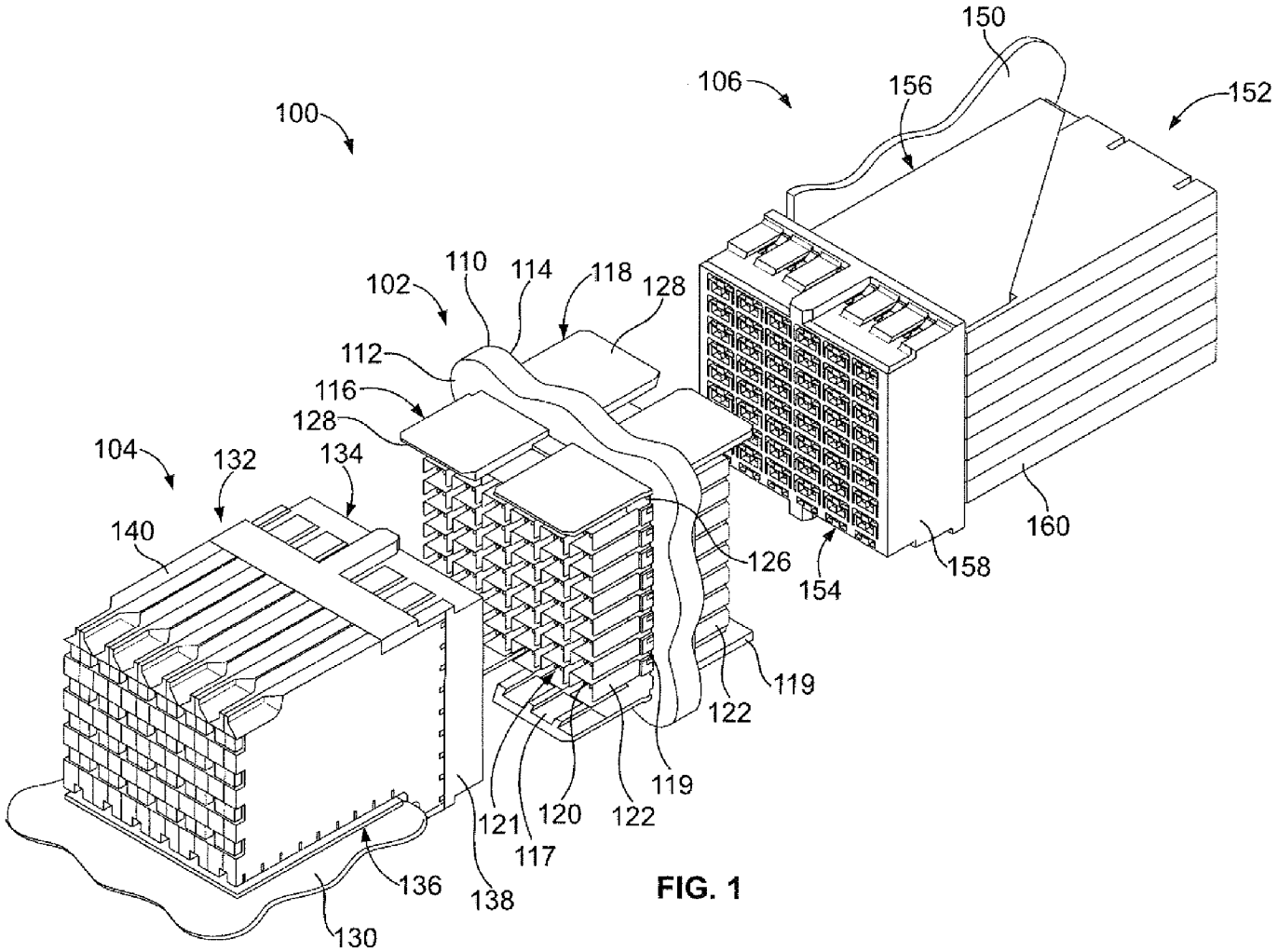
FIG. 1 is a perspective view of a communication system formed in accordance with an embodiment.

FIG. 1 is a perspective view of a communication system 100 formed in accordance with an embodiment. In particular embodiments, the communication system 100 may be a backplane or midplane communication system. The communication system 100 includes a circuit board assembly 102, a first connector system (or assembly) 104 configured to be coupled to one side of the circuit board assembly 102, and a second connector system (or assembly) 106 configured to be coupled to an opposite side the circuit board assembly 102. The circuit board assembly 102 is used to electrically connect the first and second connector systems 104, 106. Optionally, the first and second connector systems 104, 106 may be line cards or switch cards. Although the communication system 100 is configured to interconnect two connector systems in the illustrated embodiment, other communication systems may interconnect more than two connector systems or, alternatively, interconnect a single connector system to another communication device.

The circuit board assembly 102 includes a circuit board 110 having a first board side 112 and second board side 114. In some embodiments, the circuit board 110 may be a backplane circuit board, a midplane circuit board, or a motherboard. In the illustrated embodiment, the circuit board assembly 102 includes a first header connector 116 mounted to and extending from the first board side 112 of the circuit board 110. The circuit board assembly 102 also includes a second header connector 118 mounted to and extending from the second board side 114 of the circuit board 110. In alternative embodiments, the circuit board assembly 102 may only include a single header connector 116 or may include multiple header connectors 116 on the same side of the circuit board 110.

The first and second header connectors 116, 118 include connector housings 117, 119, respectively. The first and second header connectors 116, 118 also include corresponding electrical contacts 120 that are electrically connected to one another through the circuit board 110. The electrical contacts 120 may be hereinafter referred to as header contacts 120 or pin contacts 120.

The circuit board assembly 102 includes a plurality of signal paths therethrough defined by the header contacts 120 and conductive vias 170 (shown in FIG. 2) that extend through the circuit board 110. The header contacts 120 of the first and second header connectors 116, 118 may be received in the same conductive vias 170 to define a signal path directly through the circuit board 110. In an exemplary embodiment, the signal paths pass straight through the circuit board assembly 102 in a linear manner. Alternatively, the header contacts 120 of the first header connector 116 and the header contacts 120 of the second header connector 118 may be inserted into different conductive vias 170 that are electrically coupled to one another through traces (not shown) of the circuit board 110.

The first and second header connectors 116, 118 include ground shields or contacts 122 that provide electrical shielding around corresponding header contacts 120. In an exemplary embodiment, the header contacts 120 are arranged in signal pairs 121 and are configured to convey differential signals. Each of the ground shields 122 may peripherally surround a corresponding signal pair 121. As shown, the ground shields 122 are C-shaped or U-shaped and cover the corresponding signal pair 121 along three sides. The ground shields 122 may have other shapes in alternative embodiments. The header connectors 116, 118 may be provided without ground shields in alternative embodiments.

The connector housings 117, 119 couple to and hold the header contacts 120 and the ground shields 122 in designated positions relative to each other. The connector housings 117, 119 may be manufactured from a dielectric material, such as a plastic material. Each of the connector housings 117, 119 includes a mounting wall 126 that is configured to be mounted to the circuit board 110 and shroud walls 128 that extend from the mounting wall 126. The shroud walls 128 cover portions of the header contacts 120 and the ground shields 122.

The first connector system 104 includes a first circuit board 130 and a first receptacle connector 132 that is mounted to the first circuit board 130. The first receptacle connector 132 is configured to be coupled to the first header connector 116 of the circuit board assembly 102 during a mating operation. The first receptacle connector 132 has a mating interface 134 that is configured to be mated with the first header connector 116. The first receptacle connector 132 has a board interface 136 configured to be mated with the first circuit board 130. In an exemplary embodiment, the board interface 136 is orientated perpendicular to the mating interface 134. When the first receptacle connector 132 is coupled to the first header connector 116, the first circuit board 130 is orientated perpendicular to the circuit board 110.

The first receptacle connector 132 includes a front housing or shroud 138. The front housing 138 is configured to hold a plurality of contact modules 140 side-by-side. As shown, the contact modules 140 are held in a stacked configuration generally parallel to one another. In some embodiments, the contact modules 140 hold a plurality of electrical contacts 142 (shown in FIGS. 3 and 4) that are electrically connected to the first circuit board 130. The electrical contacts 142 may be hereinafter referred to as receptacle contacts 142 or mating contacts 142. The receptacle contacts 142 are configured to be electrically connected to the header contacts 120 of the first header connector 116. In an exemplary embodiment, the receptacle contacts 142 are socket contacts defining sockets that receive corresponding pin contacts 120.

The second connector system 106 includes a second circuit board 150 and a second receptacle connector 152 coupled to the second circuit board 150. The second receptacle connector 152 is configured to be coupled to the second header connector 118 during a mating operation. The second receptacle connector 152 has a mating interface 154 configured to be mated with the second header connector 118. The second receptacle connector 152 has a board interface 156 configured to be mated with the second circuit board 150. In an exemplary embodiment, the board interface 156 is orientated perpendicular to the mating interface 154. When the second receptacle connector 152 is coupled to the second header connector 118, the second circuit board 150 is orientated perpendicular to the circuit board 110.

Similar to the first receptacle connector 132, the second receptacle connector 152 includes a front housing 158 used to hold a plurality of contact modules 160. The contact modules 160 are held in a stacked configuration generally parallel to one another. The contact modules 160 hold a plurality of receptacle contacts (not shown) that are electrically connected to the second circuit board 150. The receptacle contacts are configured to be electrically connected to the header contacts 120 of the second header connector 118. The receptacle contacts of the contact modules 160 may be similar or identical to the receptacle contacts 142.

In the illustrated embodiment, the first circuit board 130 is oriented generally horizontally. The contact modules 140 of the first receptacle connector 132 are orientated generally vertically. The second circuit board 150 is oriented generally vertically. The contact modules 160 of the second receptacle connector 152 are oriented generally horizontally. As such, the first connector system 104 and the second connector system 106 may have an orthogonal orientation with respect to one another.

In alternative embodiments, rather than using the midplane circuit board assembly 102 between the two connector systems 104, 106, the connector systems 104, 106 may be directly mated together. One of the connector systems 104 may define a receptacle connector system while the other connector system 106 may define a header connector system. The receptacle connector system may be identical to the connector system 104 shown in FIG. 1, while the header connector system may include the contact modules 160, but have header contacts or pin contacts at the mating interface 154 with mating ends similar to the header contacts 120.

Figure 2:
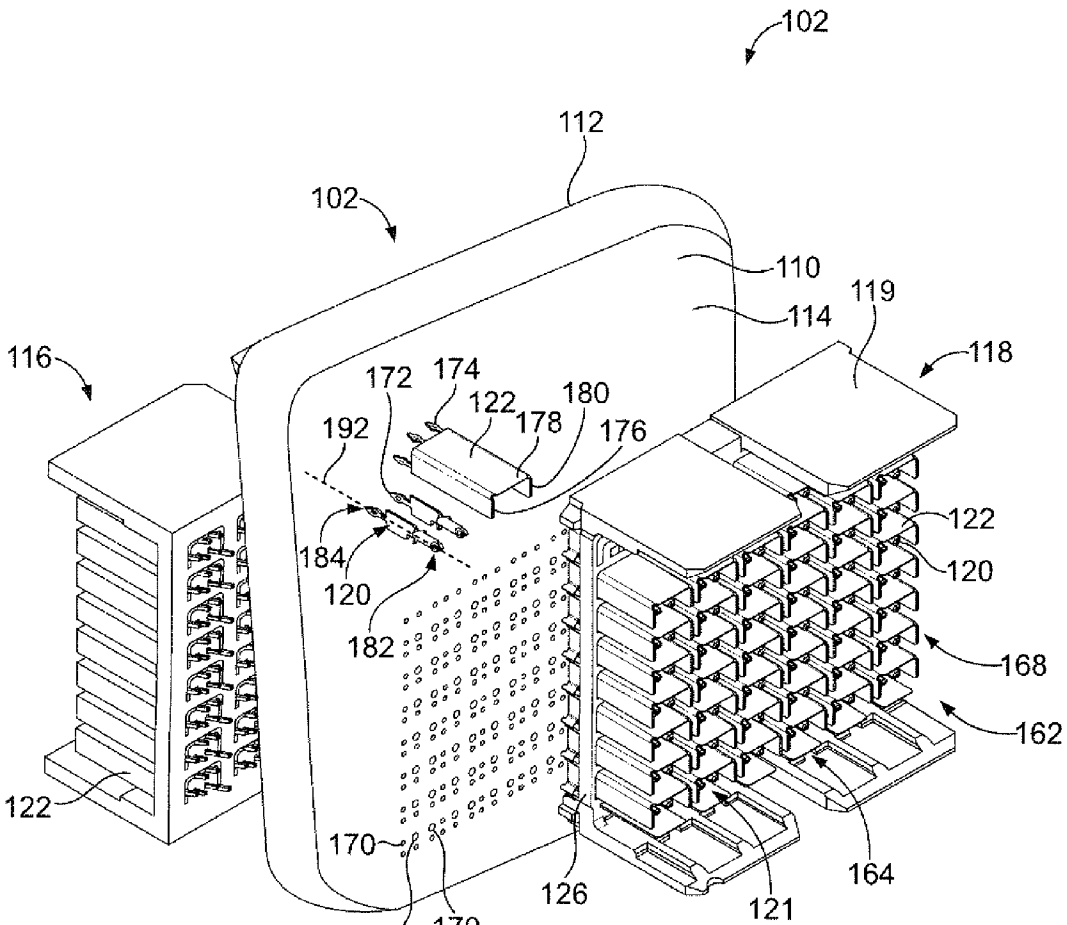
FIG. 2 is a partially exploded view of a circuit board assembly of the communication system showing header connectors formed in accordance with an exemplary embodiment.

FIG. 2 is a partially exploded view of the circuit board assembly 102 showing the first and second header connectors 116, 118 positioned for mounting to the circuit board 110. Although the following description is with respect to the header connector 118, the description may also be applicable to the header connector 116. As shown, the connector housing 119 includes a front end 162 that faces away from the second board side 114 of the circuit board 110. The connector housing 119 defines a housing cavity 164 that opens to the front end 162 and is configured to receive the second receptacle connector 152 (FIG. 1) when the second receptacle connector 152 is advanced into the housing cavity 164. As shown, the header connector 118 includes a contact array 168 that includes the header contacts 120 and the ground shields 122. The contact array 168 may include multiple signal pairs 121.

The conductive vias 170 extend into the circuit board 110. In an exemplary embodiment, the conductive vias 170 extend entirely through the circuit board 110 between the first and second board sides 112, 114. In other embodiments, the conductive vias 170 extend only partially through the circuit board 110. The conductive vias 170 are configured to receive the header contacts 120 of the first and second header connectors 116, 118. For example, the header contacts 120 include compliant pins 172 that are configured to be loaded into corresponding conductive vias 170. The compliant pins 172 mechanically engage and electrically couple to the conductive vias 170. Likewise, at least some of the conductive vias 170 are configured to receive compliant pins 174 of the ground shields 122. The compliant pins 174 mechanically engage and electrically couple to the conductive vias 170. The conductive vias 170 that receive the ground shields 122 may surround the pair of conductive vias 170 that receive the corresponding pair of header contacts 120. The header contacts 120 and ground shields 122 may be electrically connected to the circuit board 110 by other components or processes in alternative embodiments.

The ground shields 122 are C-shaped and provide shielding on three sides of the signal pair 121. The ground shields 122 have a plurality of walls, such as three planar walls 176, 178, 180. The planar walls 176, 178, 180 may be integrally formed or alternatively, may be separate pieces. The compliant pins 174 extend from each of the planar walls 176, 178, 180 to electrically connect the planar walls 176, 178, 180 to the circuit board 110. The planar wall 178 defines a center wall or top wall of the ground shield 122. The planar walls 176, 180 define side walls that extend from the planar wall 178. The planar walls 176, 180 may be generally perpendicular to the planar wall 178. In alternative embodiments, other configurations or shapes for the ground shields 122 are possible in alternative embodiments. For example, more or fewer walls may be provided in alternative embodiments. The walls may be bent or angled rather than being planar. In other embodiments, the ground shields 122 may provide shielding for individual header contacts 120 or sets of contacts having more than two header contacts 120.

The header contact 120 includes a mating end 182 and a board end 184. The board end 184 is configured to engage the circuit board 110. The mating end 182 may represent the portion of the header contact 120 that is located furthest from the circuit board 110 or the mounting wall 126 and is the first to engage or interface with the mating contacts of the receptacle connector 152 (FIG. 1). As shown, the header contact 120 has a central longitudinal axis 192 extending therethrough between the board end 184 and the mating end 182. The longitudinal axis 192 may extend through an approximate center of the header contact 120.

Figure 3:
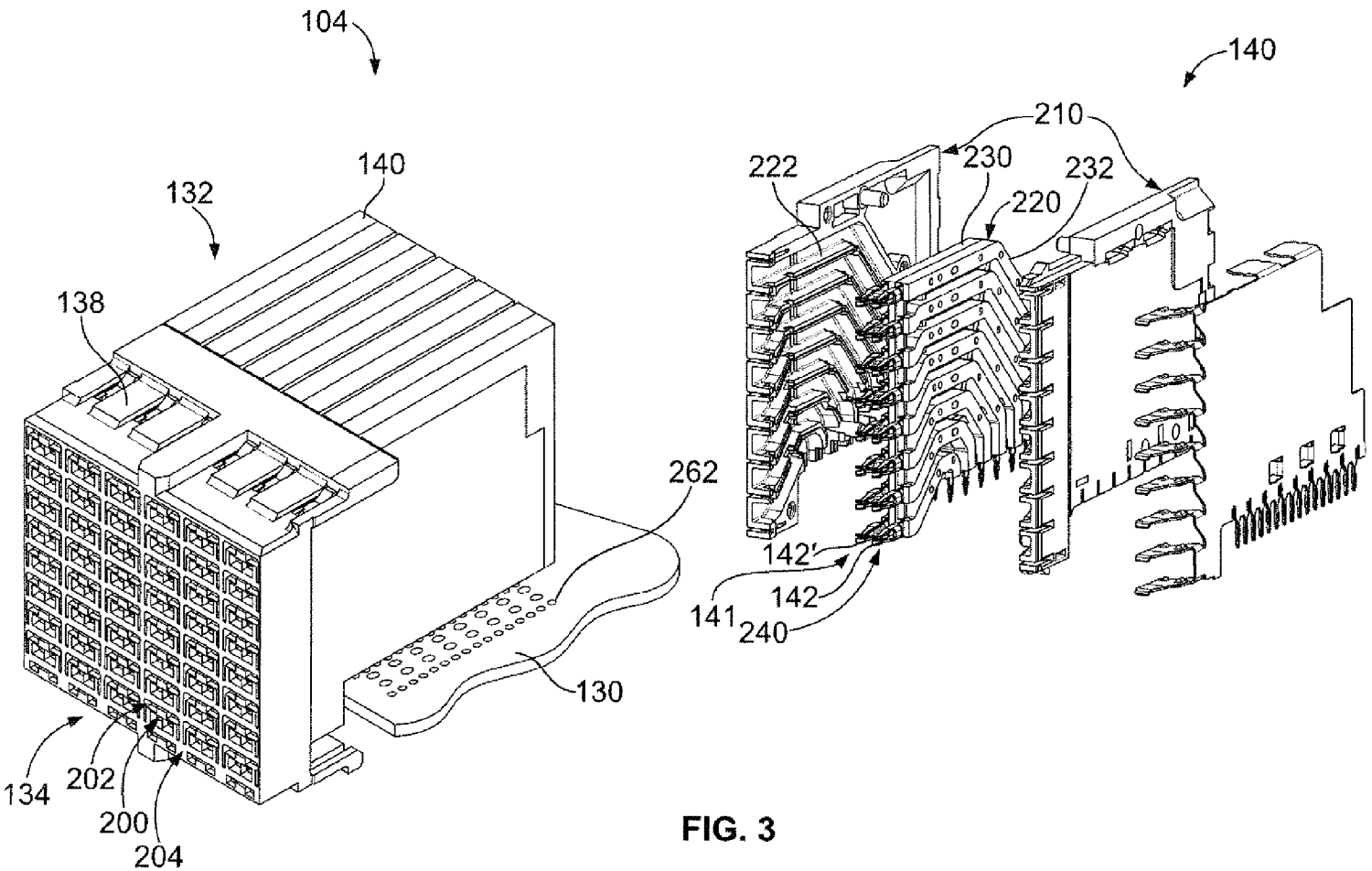
FIG. 3 is a partially exploded view of a connector system of the communication system.

FIG. 3 is a partially exploded view of the first connector system 104 including the first receptacle connector 132. Although the following description is with respect to the first receptacle connector 132, the description may be similarly applied to the second receptacle connector 152 (FIG. 1). FIG. 3 illustrates one of the contact modules 140 in an exploded state. The front housing 138 includes a plurality of contact openings 200, 202 at a front end 204 of the front housing 138. The front end 204 defines the mating interface 134 of the first receptacle connector 132 that engages the first header connector 116 (FIG. 1).

The contact modules 140 are coupled to the front housing 138 such that the receptacle contacts 142 are received in corresponding contact openings 200. Optionally, a single receptacle contact 142 may be received in each contact opening 200. The contact openings 200 may be configured to receive corresponding header contacts 120 (FIG. 1) therein when the receptacle and header connectors 132, 116 are mated. The contact openings 202 receive corresponding ground shields 122 (FIG. 1) therein when the receptacle and header connectors 132, 116 are mated.

In some embodiments, the contact module 140 includes a conductive holder 210 fabricated from a conductive material to provide electrical shielding for the first receptacle connector 132. The conductive holder 210 is configured to support a frame assembly 220 that includes a plurality of the receptacle contacts 142. In the illustrated embodiment, the frame assembly 220 includes a pair of dielectric frames 230, 232 overmolded over leadframes that define the receptacle contacts 142. The receptacle contacts 142 include mating ends 240 that are configured to be mated with corresponding header contacts 120. Optionally, the receptacle contacts 142 are arranged as signal pairs 141.

Figure 4:
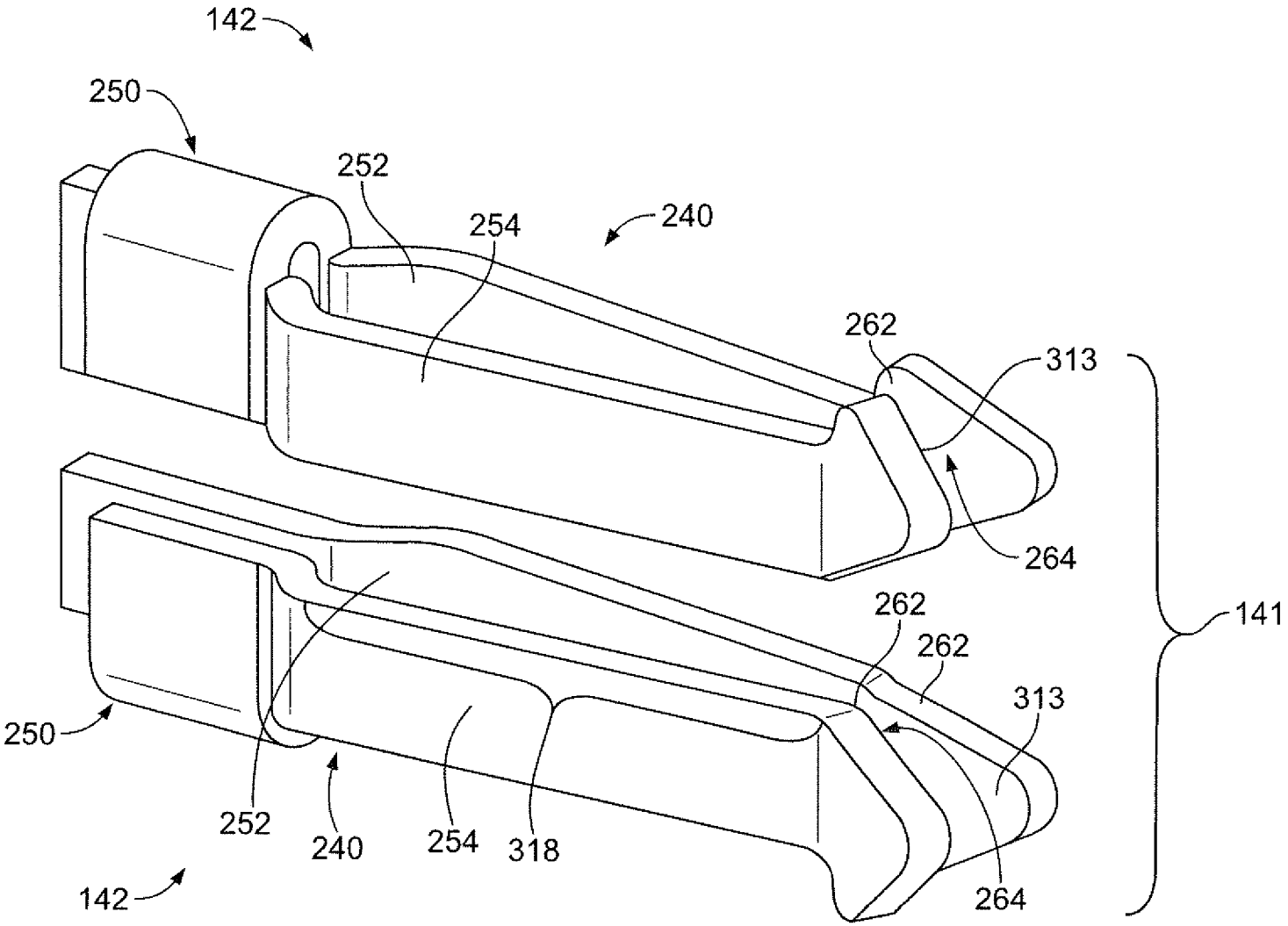
FIG. 4 is an isolated perspective view of portions of receptacle contacts of the connector system shown in FIG. 3.

FIG. 4 is an isolated perspective view of portions of two receptacle contacts 142 showing the mating ends 240 of one of the signal pairs 141 of the receptacle contacts 142. Each of the receptacle contacts 142 of the signal pair 141 is configured to mechanically and electrically engage a corresponding header contact 120 (FIG. 1) of the same signal pair 121 (FIG. 1). Each of the receptacle contacts 142 may be stamped from a common sheet of material, such as from the leadframe, and be shaped to include a contact base 250 and a pair of elongated, flexible contact fingers 252, 254 that project from the corresponding contact base 250. In the illustrated embodiment, the receptacle contacts 142 are similar, and may be identical. As such, the following description is applicable to each of the receptacle contacts 142. It should be understood, however, that the receptacle contacts 142 of the signal pair 141 or of the second receptacle connector 152 are not required to be identical.

The contact fingers 252, 254 have respective mating interfaces 262. The mating interfaces 262 of the contact fingers 252, 254 face each other with a contact-receiving gap 264 therebetween. In the illustrated embodiment, the corresponding mating interfaces 262 of the contact fingers 252, 254 are substantially paddle-shaped or tab-shaped. The mating interface 262 includes a flared portion that extends away from the opposing mating interface 262 to enlarge the contact-receiving gap 264. The curved contour of the mating interfaces 262 and the flared portions may facilitate receiving one of the header contacts 120 (FIG. 1) within the contact-receiving gap 264.

In FIG. 4, the contact fingers 252, 254 are in a relaxed condition or state. During a mating operation between, for example, the first header connector 116 (FIG. 1) and the first receptacle connector 132 (FIG. 1), each of the header contacts 120 (FIG. 1) is received within a contact-receiving gap 264 of a corresponding receptacle contact 142. The opposing mating interfaces 262 may engage opposite sides of the header contact 120. As the header contact 120 is advanced through the contact-receiving gap 264, the header contact 120 deflects the contact fingers 252, 254 away from each other.

As described in greater detail below, when the contact fingers 252, 254 are in deflected conditions, each of the contact fingers 252, 254 may generate a normal force that presses the corresponding mating interface 262 against the corresponding header contact 120 in a direction toward the other mating interface 262. As such, the contact fingers 252, 254 may pinch the corresponding header contact 120 therebetween. To this end, each of the contact fingers 252, 254 may be configured to provide a designated normal force when the corresponding contact finger 252, 254 is in a deflected condition.

Figure 5:
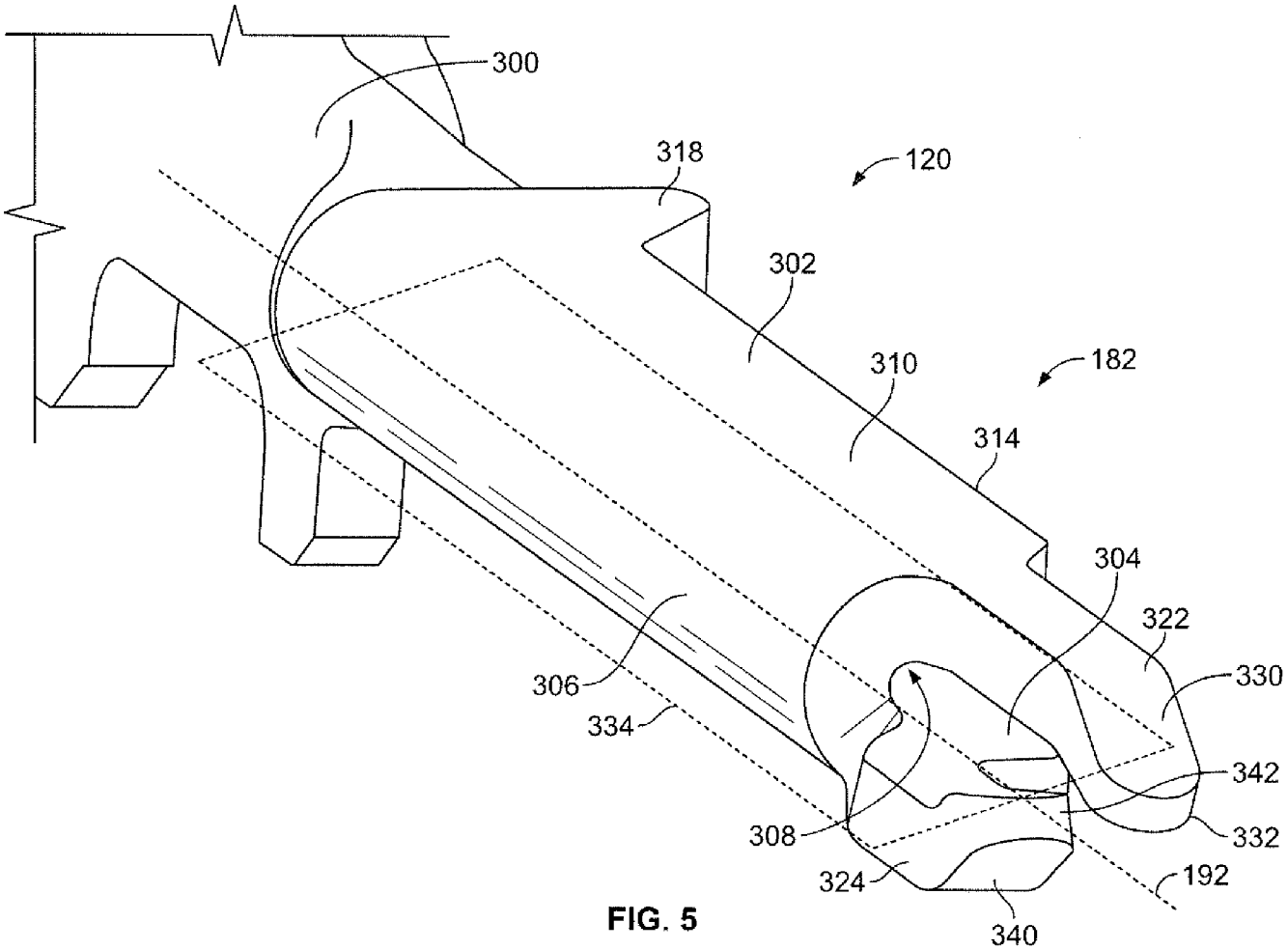
FIG. 5 is a front perspective view of a header contact of the header connector shown in FIG. 2 and formed in accordance with an exemplary embodiment.
Figure 6:
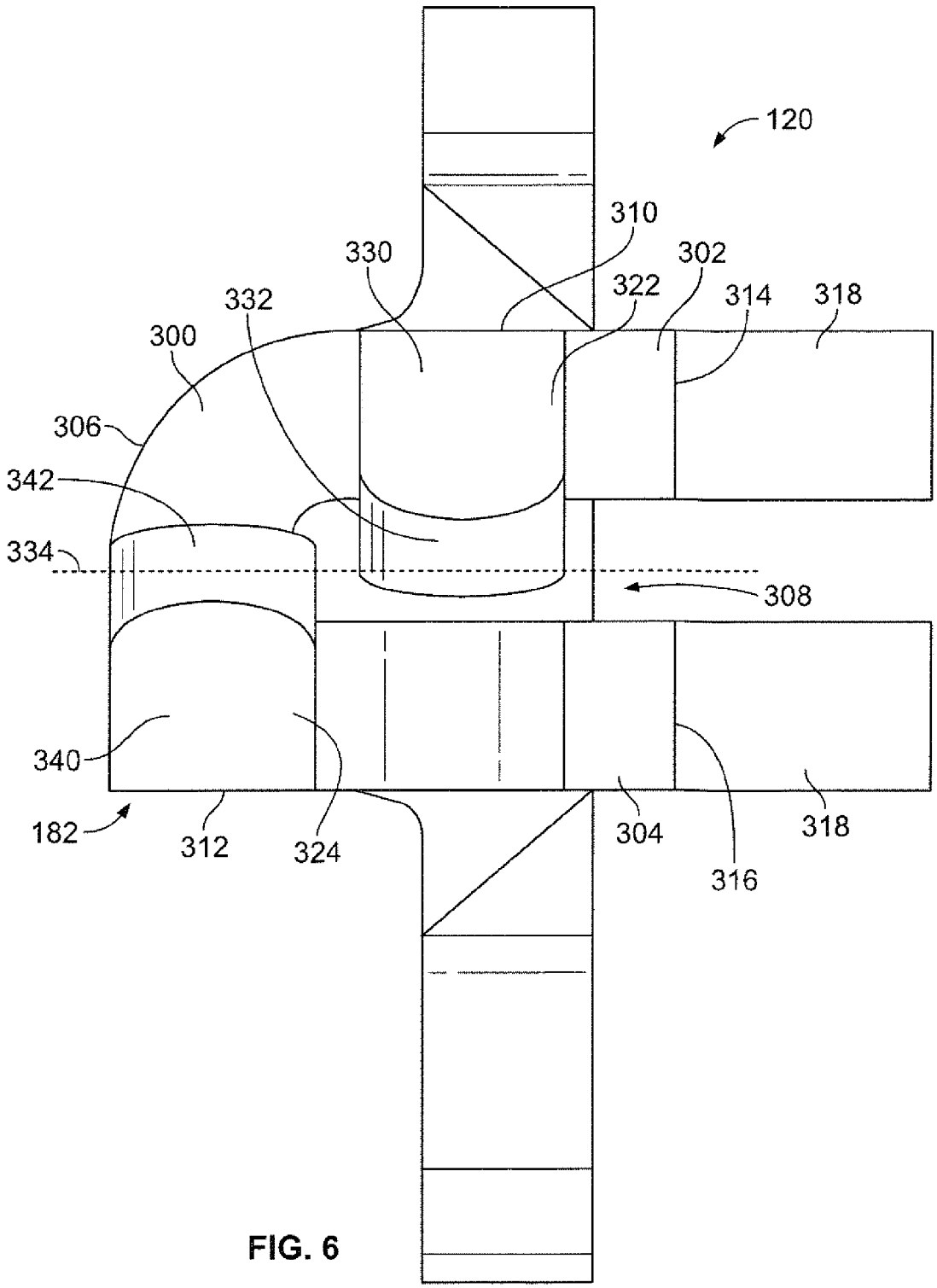
FIG. 6 is a front view of the header contact shown in FIG. 5.

FIG. 5 is a front perspective view of an exemplary header contact 120. FIG. 6 is a front view of the exemplary header contact 120. The header contact 120 includes an elongated body 300 that extends along the longitudinal axis 192. The elongated body 300 has a U-shaped profile along the longitudinal axis 192 defined by a generally planar first arm 302 and a generally planar second arm 304 with a folded end 306 connecting the first and second arms 302, 304. A central plane 334 passes through the longitudinal axis and is generally centered between the first and second arms 302, 304. The second arm 304 is oriented generally parallel to the central plane 334 and to the first arm 302. The second arm 304 is spaced apart from the first arm 302 by a body gap 308. The central plane 334 passes through the body gap 308. The first and second arms 302, 304 may be formed by bending or folding over portions of the mating end 182 of the header contact 120 into the U-shape. The first and second arms 302, 304 may be deflectable or compressible toward each other, such as when mated with the corresponding receptacle contact 142 (shown in FIG. 4).

The first and second arms 302, 304 have exterior surfaces 310, 312, respectively, facing in opposite directions that define wiping surfaces and/or mating interfaces for the flexible contact fingers 252, 254 (shown in FIG. 4). The first and second arms 302, 304 extend to outer edges 314, 316, respectively, which are generally opposite the folded end 306. Optionally, the outer edges 314, 316 may be aligned with each other across the body gap 308. The first and second arms 302, 304 have aligning tabs 318 extending from the outer edges 314, 316 that are used for positioning or aligning the header contact 120 with respect to the housing 117 or 119.

The header contact 120 includes first and second deflectable beams 322, 324 at the mating end 182. The first and second deflectable beams 322, 324 are configured to be deflected in opposite directions. In an exemplary embodiment, the first and second deflectable beams 322, 324 are laterally offset with respect to one another. As such, the first and second deflectable beams 322, 324 bypass each other during the mating operation.

The first deflectable beam 322 extends forward from the first arm 302 and is angled inward. For example, the first deflectable beam 322 is pitched inward to at least partially extend across the body gap 308. In an exemplary embodiment, the first deflectable beam 322 is offset relative to the second deflectable beam 324 toward the outer edge 314 of the first arm 302 such that the first deflectable beam 322 is able to bypass the second deflectable beam 324 during the mating operation. The first deflectable beam 322 is configured to be engaged by the first flexible contact finger 252 during the mating operation. The first deflectable beam 322 is configured to be deflected toward the central plane 334 during the mating operation. For example, in the illustrated orientation, the first deflectable beam 322 will be deflected downward by the flexible contact finger 252.

The first deflectable beam 322 includes a sloped surface 330 extending to a tip 332 of the first deflectable beam 322. The sloped surface 332 is angled toward the second deflectable beam 324. Optionally, the tip 332 may pass across a central plane 334 of the header contact 120 that passes through the longitudinal axis 192 and is oriented generally parallel to the first and second arms 302, 304. The central plane 334 may be centered between the first and second arms 302, 304. The sloped surface 330 may be slightly forward facing to provide a lead-in for mating with the flexible contact finger 252. The sloped surface 330 provides a lead-in to the wiping surface defined by the exterior surface 310.

The second deflectable beam 324 extends forward from the second arm 304 and is angled inward. For example, the second deflectable beam 324 is pitched inward to at least partially extend across the body gap 308. In an exemplary embodiment, the second deflectable beam 324 is offset relative to the first deflectable beam 322 toward the folded end 306 such that the second deflectable beam 324 is able to bypass the first deflectable beam 322 during the mating operation. The second deflectable beam 324 is configured to be engaged by the second flexible contact finger 254 during the mating operation. The second deflectable beam 324 is configured to be deflected toward the central plane 334 during the mating operation. For example, in the illustrated orientation, the second deflectable beam 324 will be deflected upward by the flexible contact finger 254.

The second deflectable beam 324 includes a sloped surface 340 extending to a tip 342 of the second deflectable beam 324. The sloped surface 342 is angled toward the first deflectable beam 322. Optionally, the tip 342 may pass across the central plane 334. The sloped surface 340 may be slightly forward facing to provide a lead-in for mating with the flexible contact finger 254. The sloped surface 340 provides a lead-in to the wiping surface defined by the exterior surface 312.

Figure 7:
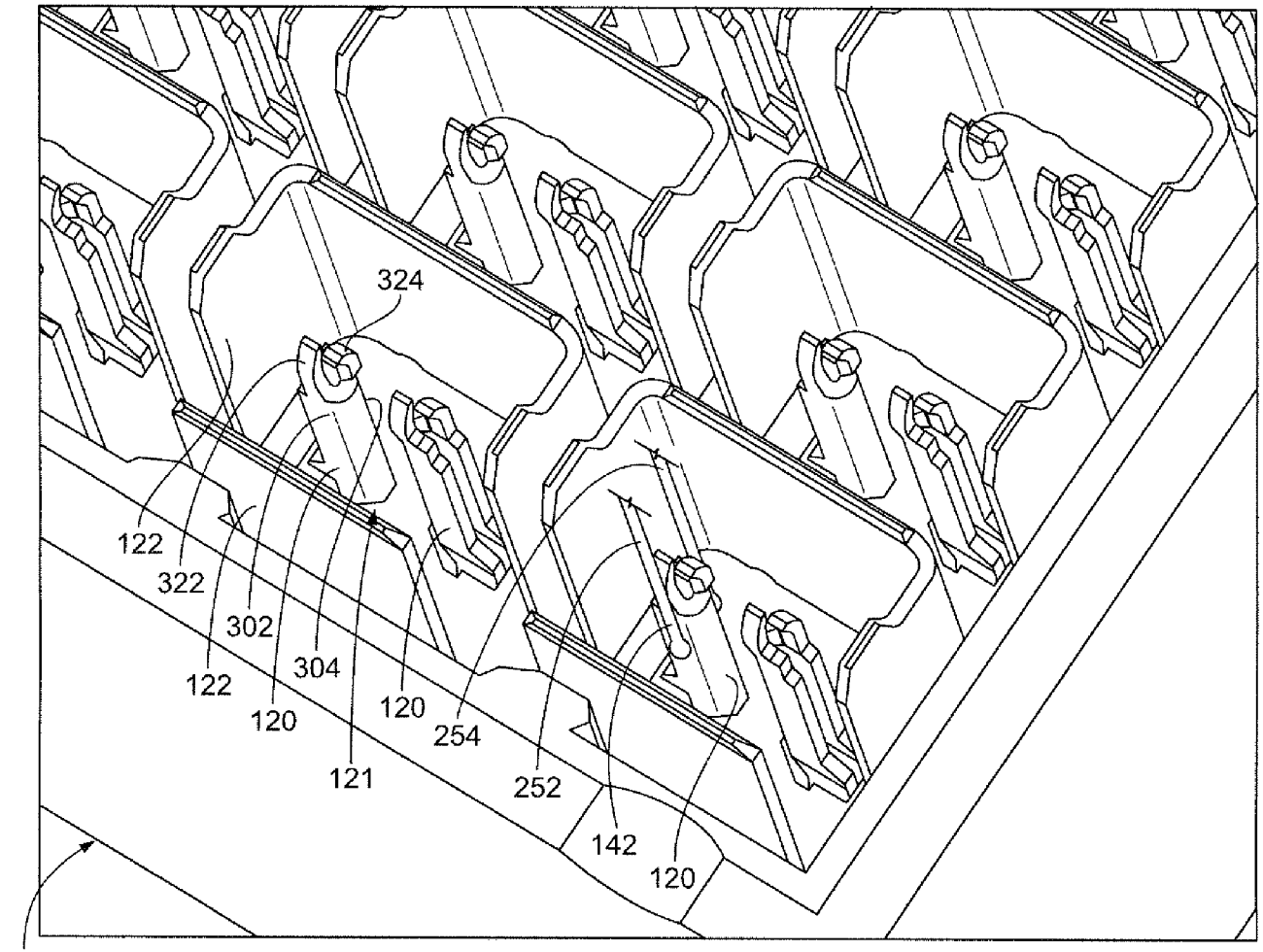
FIG. 7 is an enlarged perspective view of a portion of the header connector shown in FIG. 2.

FIG. 7 illustrates a portion of the header connector 118 showing the header contacts 120 and ground shields 122 surrounding the signal pairs 121 of the header contacts 120. The deflectable beams 322, 324 are poised for mating with corresponding flexible contact fingers 252, 254. The deflectable beams 322, 324 are compressed or flexed inward during the mating operation. The deflectable beams 322, 324 are offset or staggered to allow the deflectable beams 322, 324 to bypass each other when mated with the corresponding flexible contact fingers 252, 254. As the deflectable beams 322, 324 are flexed inward, the mating forces are reduced making it easier to mate the connector system 104 (shown in FIG. 1) with the header connector 118. The flexible contact fingers 252, 254 eventually slide past the deflectable beams 322, 324 to the arms 302, 304 and wipe along a length of the arms 302, 304 to a final mated position. Optionally, the deflectable beams 322, 324 do not engage the contact fingers 252, 254 in the final mated position. Alternatively, the deflectable beams 322, 324 may engage portions of the corresponding receptacle contact 142 to create additional points of contact between the header contact 120 and receptacle contact 142, which may reduce any electrical stub.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled.

As used in the description, the phrase "in an exemplary embodiment" and the like means that the described embodiment is just one example. The phrase is not intended to limit the inventive subject matter to that embodiment. Other embodiments of the inventive subject matter may not include the recited feature or structure. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector housing configured to engage a mating connector during a mating operation;

a contact array including pin contacts coupled to the connector housing, each of the pin contacts having an elongated body including a central plane that extends along a longitudinal axis to a mating end, the elongated body being rigid along an edge of the mating end to an end portion of the mating end, each of the pin contacts having first and second deflectable beams at the end portion of the mating end, the first deflectable beam being configured to engage a first flexible contact finger of the mating connector and deflect toward the central plane during the mating operation, the second deflectable beam being configured to engage a second flexible contact finger of the mating connector and deflect toward the central plane during the mating operation.

2. The electrical connector of claim 1, wherein the first and second deflectable beams are laterally offset with respect to one another.

3. The electrical connector of claim 1, wherein the first and second deflectable beams extend forward of the rigid mating end and are resiliently deflectable to allow deflection of the first and second deflectable beams relative to each other in opposite directions.

4. The electrical connector of claim 1, wherein the first deflectable beam bypasses the second deflectable beam during the mating operation.

5. The electrical connector of claim 1, wherein the first deflectable beam includes a sloped surface extending to a tip of the first deflectable beam, the second deflectable beam including a sloped surface extending to a tip of the second deflectable beam, the sloped surface of the first deflectable beam being angled toward the second deflectable beam, the sloped surface of the second deflectable beam being angled toward the first deflectable beam.

6. The electrical connector of claim 1, wherein the first deflectable beam includes an exterior surface and the second deflectable beam includes an exterior surface facing in an opposite direction as the exterior surface of the first deflectable beam, the exterior surfaces of the first and second deflectable beams being configured to engage the first and second flexible contact fingers, respectively.

7. The electrical connector of claim 1, wherein the elongated body has a U-shaped profile along the longitudinal axis defined by a generally planar first arm, a generally planar second arm generally parallel to the first arm and spaced apart by a body gap, and a folded end connecting the first and second arms defining the rigid edge of the mating end, the first deflectable beam extending forward from the first arm and being pitched inward to at last partially extend across the body gap, the second deflectable beam extending forward from the second arm and being pitched inward to at least partially extend across the body gap.

8. The electrical connector of claim 7, wherein the first and second arms have outer edges opposite the folded end, the first deflectable beam being offset relative to the second deflectable beam toward the outer edge of the first arm, the second deflectable beam being offset relative to the first deflectable beam toward the folded end.

9. The electrical connector of claim 7, wherein a central plane passes through the longitudinal axis between, and generally parallel to, the first and second arms, the first deflectable beam having a tip passing across the central plane, the second deflectable beam having a tip passing across the central plane.

10. The electrical connector of claim 1, wherein the mating end is rigid at the edge along a majority of a length of the mating end of the elongated body.

11. A communication system comprising:

a receptacle connector comprising a contact array of receptacle contacts, the receptacle contacts each having first and second flexible contact fingers opposing each other across a socket gap; and a header connector comprising a contact array of header contacts that engage corresponding receptacle contacts of the receptacle connector, each of the header contacts having an elongated body including a central plane that extends along a longitudinal axis to a mating end, the elongated body being rigid along an edge of the mating end to an end portion of the mating end, each of the header contacts having first and second deflectable beams at the end portion of the mating end;

wherein the mating ends of the header contacts are received in the socket gaps of corresponding receptacle contacts during the mating operation with the end portions of the mating ends of the header contacts initially engaging the receptacle contacts, the first deflectable beam engaging the first flexible contact finger of the mating connector such that the first deflectable beam is deflected inward toward the central plane and such that the first flexible contact finger is deflected outward away from the longitudinal axis, the second deflectable beam engaging the second flexible contact finger of the mating connector such that the second deflectable beam is deflected inward toward the central plane and such that the second flexible contact finger is deflected outward away from the longitudinal axis, the rigid edge of the mating end thereafter being positioned between the first and second flexible contact fingers as the mating end is plugged into the corresponding receptacle contact with the mating end being largely undeflected along the rigid edge as compared to the deflection of the first and second deflectable beams.

12. The communication system of claim 11, wherein the first and second deflectable beams are laterally offset with respect to one another.

13. The communication system of claim 11, wherein the first and second deflectable beams are deflected in opposite directions.

14. The communication system of claim 11, wherein the first deflectable beam bypasses the second deflectable beam during the mating operation.

15. The communication system of claim 11, wherein the first deflectable beam includes a sloped surface extending to a tip of the first deflectable beam, the second deflectable beam including a sloped surface extending to a tip of the second deflectable beam, the sloped surface of the first deflectable beam being angled toward the second deflectable beam, the sloped surface of the second deflectable beam being angled toward the first deflectable beam.

16. An electrical contact comprising:

an elongated body that extends along a longitudinal axis, the elongated body having a U-shaped profile along the longitudinal axis defined by a generally planar first arm, a generally planar second arm parallel to the first arm and spaced apart by a body gap, and a folded end connecting the first and second arms, the folded end defining a rigid edge of the elongated body, the first and second arms having exterior surfaces facing in opposite directions that are configured to engage corresponding first and second flexible contact fingers of a mating connector during a mating operation, the elongated body having a mating end extending along a central plane to an end portion of the mating end with the first and second arms on opposite sides of the central plane;

a first deflectable beam at the end portion of the mating end extending forward from the first arm, the first deflectable beam being pitched inward to at least partially extend across the body gap, the first deflectable beam being configured to engage the first flexible contact finger and deflect toward the central plane during the mating operation; and a second deflectable beam at the end portion of the mating end extending forward from the second arm, the second deflectable beam being pitched inward to at least partially extend across the body gap, the second deflectable beam being configured to engage the second flexible contact finger and deflect toward the central plane during the mating operation.

17. The electrical contact of claim 16, wherein the first and second deflectable beams are laterally offset with respect to one another.

18. The electrical contact of claim 16, wherein the first deflectable beam bypasses the second deflectable beam during the mating operation.

19. The electrical contact of claim 16, wherein the first deflectable beam includes a sloped surface extending to a tip of the first deflectable beam, the second deflectable beam including a sloped surface extending to a tip of the second deflectable beam, the sloped surface of the first deflectable beam being angled toward the second deflectable beam, the sloped surface of the second deflectable beam being angled toward the first deflectable beam.

20. The electrical contact of claim 16, wherein the first and second arms have outer edges opposite the folded end, the first deflectable beam being offset relative to the second deflectable beam toward the outer edge of the first arm, the second deflectable beam being offset relative to the first deflectable beam toward the folded end.

* * * * *